US005386273A

United States Patent [19]

Wood et al.

[11] Patent Number: 5,386,273

[45] Date of Patent: Jan. 31, 1995

[54] BELT PHOTORECEPTOR ON CYLINDRICAL MANDREL

[75] Inventors: Larry M. Wood, Rochester; Lam F. Wong, Fairport, both of N.Y.

[73] Assignee: Xerox Corporation, Stamford, Conn.

[21] Appl. No.: 13,902

[22] Filed: Feb. 5, 1993

[51] Int. Cl.[6] ..... G03G 15/00

[52] U.S. Cl. ..... 355/212; 355/210; 474/117

[58] Field of Search ..... 355/210, 211, 212, 200; 474/117, 101, 110, 115, 120, 129, 119; 198/813-816, 837

[56] References Cited

U.S. PATENT DOCUMENTS

| | | | |
|---|---|---|---|
| 3,877,806 | 4/1975 | Schrempp et al. | 355/212 X |
| 3,998,542 | 12/1976 | Toto et al. | 355/212 X |
| 4,551,001 | 11/1985 | Yokota | 355/212 |
| 4,674,858 | 6/1987 | Nagayama | 355/212 |
| 4,769,672 | 9/1988 | Hoshi et al. | 355/212 X |
| 4,983,146 | 1/1991 | Charles et al. | 474/117 |
| 5,016,062 | 5/1991 | Rapkin | 355/327 |
| 5,021,829 | 6/1991 | Johnson et al. | 355/213 |
| 5,070,365 | 12/1991 | Agarwal | 355/212 |

*Primary Examiner*—A. T. Grimley
*Assistant Examiner*—T. A. Dang
*Attorney, Agent, or Firm*—Fay, Sharpe, Beall, Fagan, Minnich & McKee

[57] ABSTRACT

A photoreceptor apparatus constructed of a photoreceptor belt releasably attached to the surface of a cylindrical mandrel. The photoreceptor belt is preferably attached to the mandrel by means of a slot in mandrel capable of accepting a portion of the belt and retained therein by means of a releasable key.

11 Claims, 2 Drawing Sheets

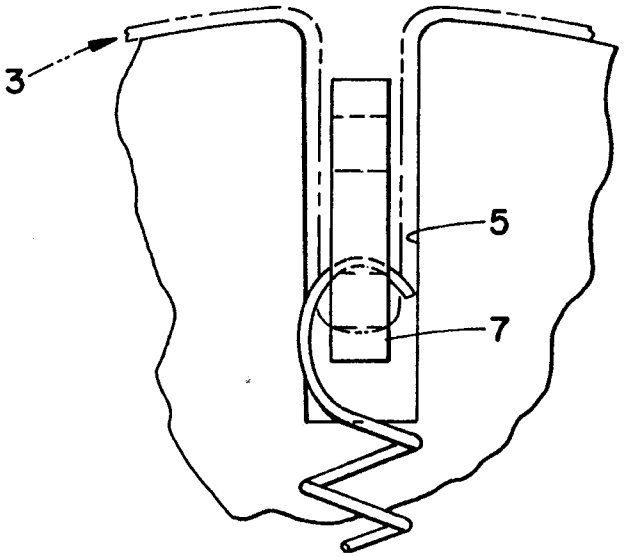
FIG. IB
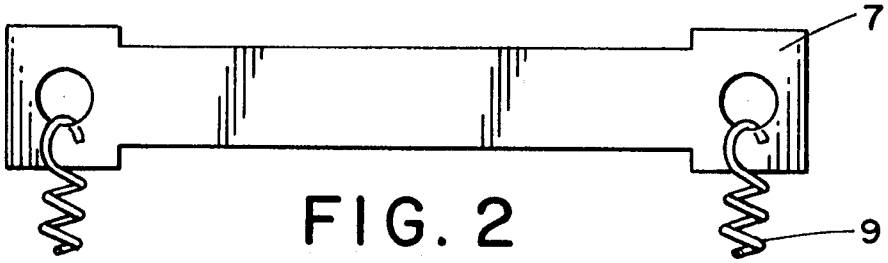
FIG. 2
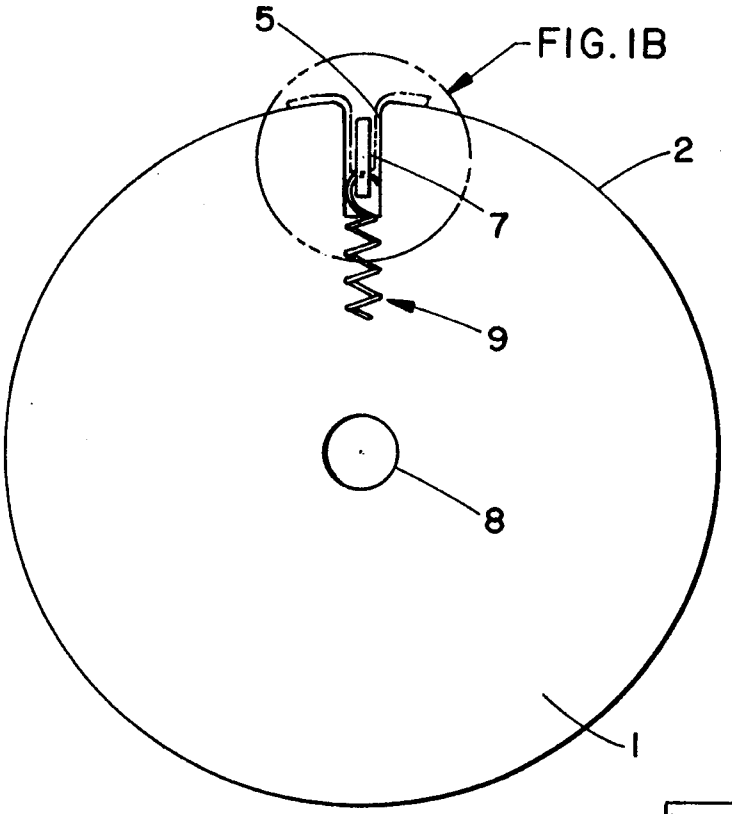
FIG. IA

BELT PHOTORECEPTOR ON CYLINDRICAL MANDREL

BACKGROUND OF THE INVENTION

1. Field of the Invention

This invention relates to photoreceptors for electrophotographic printing. Particularly, this invention relates to a photoreceptor belt in combination with a cylindrical mandrel. More particularly, this invention relates to a photoreceptor belt removably attached to a cylindrical mandrel.

The photoreceptor design of the invention is particularly well suited to replace the current belt or drum photoreceptor designs of electrophotographic printing machines. The current invention will extend the life of the photoreceptor, increase ease of replacement, and reduce the number of complex parts required in a photoreceptor assembly.

2. Description of the Art

In an electrophotographic mono-color printing machine, a photoconductive member is charged to a substantially uniform potential. The charged portion of the photoconductive member is exposed to a light reflected original document image. Exposure of the charged photoconductive member selectively dissipates the charge in the irradiated areas. This records an electrostatic latent image on the photoconductive member corresponding to the informational areas contained within the original document being reproduced. After the electrostatic latent image is recorded on the photoconductive member, the latent image is developed by bringing it into contact with toner. The toner image on the photoconductive member is subsequently transferred to a copy sheet. The copy sheet is heated to permanently affix the toner image. Multicolor electrophotographic printing is substantially identical, although more complex than the mono-color printing process. Cyclic and tandem color copying processes dominate the art of color printing.

In a cyclic multicolor printing process, successive latent images corresponding to different colors are recorded on the photoconductive member during each cycle. Accordingly, one photoconductive member is required in this type of machine. The photoconductive member is used repetitively for each color/cycle. Each single color electrostatic latent image is developed with toner of a color complementary thereto. This process is repeated a plurality of cycles for the different colors in an image and the respective complementary color toner. Each single color toner image is transferred to the copy sheet and superimposed with the prior toner image. This creates a multilayered toner image on the copy sheet. Thereafter, the multilayered toner image is permanently affixed to the copy sheet creating a color copy. The primary attributes of a cyclic printing machine are its relatively low number of parts and its low cost. U.S. Pat. No. 4,583,991, herein incorporated by reference, describes a cyclic printing machine in which a sheet moves in recirculated path and successive color toners images are transferred thereto.

A typical tandem printing machine uses multiple printing engines to transfer, in one cycle, different colored toner images directly to a sheet or to an intermediate for subsequent transfer to the sheet. Printing rate is the primary advantage of a tandem machine since all colors are printed in one cycle. However, the complex equipment of a tandem machine leads to a higher cost.

U.S. Pat. Nos. 4,796,050 and 4,803,518, herein incorporated by reference, disclose tandem printing machines having a plurality of photoconductive drums arranged such that color separated light images of an original document are recorded thereon as electrostatic latent images. The latent images are developed into visible color images. A conveyor advances a sheet past each photoconductive drum. Visible color images are transferred from each photoconductive drum to the sheet.

Both cyclic and tandem printing machines can use drum or belt type photoreceptors. Problems are encountered in the use of photoconductive belts because of their reliability, the life of the belt modules, and their difficulty of replacement. In addition, belt modules often experience inboard/outboard travel or even travel in the direction of paper flow. Drum photoconductors are troublesome because of their high cost and their difficulty to replace.

SUMMARY OF THE INVENTION

Accordingly, it is a primary object of this invention to provide a new and improved photoreceptor.

It is a further object of this invention to provide a new and improved photoreceptor having an extended life.

A still further object of this invention is to provide a new and improved photoreceptor that can be easily replaced in an electrophotographic machine.

Another object of the invention is to provide a new and improved low cost photoreceptor.

Additional objects and advantages of the invention will be set forth in part in the description which follows and a part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the photoreceptor of this invention comprises a cylindrical mandrel having a photoreceptor belt attached thereto. Attached as used herein means the photoreceptor belt is substantially fixed in place on at least a portion of a longitudinal surface of the mandrel and covers the full circumference of the mandrel at the longitudinal surface. Preferably, the means for attaching the belt to the mandrel comprises a slot in the mandrel which accepts the photoreceptor belt and is held in place by a key-type mechanism. More preferably, the key is releasable, allowing the belt to be removed from the mandrel and replaced with a new belt. Preferably, the photoreceptor belt is a multilayered continuous belt.

In one embodiment, the key-type mechanism includes at least two springs. The springs are capable of maintaining the belt under a tension of about one half pound per inch to about two pounds per inch, preferably about one pound per inch width of the belt. Preferably, the key is as wide as the mandrel is long. Preferably, the photoreceptor belt is between about 5 and 25 percent longer in length than the circumference of the mandrel.

The photoreceptor of the current invention is utilizable as a replacement for previously known photoreceptor drums in printing machines, for example U.S. Pat. No. 5,121,171, herein incorporated by reference.

The photoreceptor belt utilized in the current invention can be any type. U.S. Pat. No. 4,265,990, describes acceptable photoreceptors.

BRIEF DESCRIPTION OF THE DRAWINGS

The invention consists in the novel parts, construction, arrangements, combinations and improvements shown and described. The accompanying drawings, which are incorporated in and constitute a part of the specification illustrate one embodiment of the invention and, together with the description, serve to explain the principles of the invention.

FIG. 1 is an end view of the photoreceptor apparatus;

FIG. 1A is a detail view of the slot and key mechanism; and,

FIG. 2 is a side plan view of a preferred key apparatus.

DETAILED DESCRIPTION OF THE INVENTION

Reference will now be made in detail to the present preferred embodiment of the invention, an example of which is illustrated in the accompanying drawings.

While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

Referring now to FIGS. 1 and 1A, it may be seen that the invention comprises a cylindrical mandrel 1 having a surface 2 about which photoreceptor belt 3 can be wrapped. The mandrel includes a slot 5 into which the photoreceptor belt 3 is recessed and held in place by key 7. The mandrel 1 may also include a hole 8 for mounting in an electrophotoreceptor printing machine. In a preferred embodiment, as shown in FIGS. 1 and 2, key 7 includes springs 9 to releasably hold the belt in place.

Alternative mechanisms of retaining the continuous photoreceptor belt on the mandrel may include screws or a latching mechanism. In the case of photoreceptor belt sheets, additional mounting techniques include grippers or pick-up spools at the ends of the belt.

The mandrel is generally cylindrical and shaped in the mode of photoreceptor drums, however the invention is not limited to that particular shape. Preferably, the mandrel is substantially cylindrical in shape and the longitudinal section along the rotation axis of the cylinder is sufficiently larger than the transverse section. In the current invention, the mandrel circumference is not limited and the photoreceptor belt is suggested to be approximately 5–25 percent longer in circumferential length. Preferably, the belt is approximately 10 percent larger in circumference than the mandrel. This additional length facilitates the loading of the photoreceptor belt onto the mandrel and is taken up via the slot or alternate means for attaching the photoreceptor belt to the mandrel. Generally, the photoreceptor belt is at least 50 percent as wide as the mandrel is long. Preferably, the photoreceptor belt is 90 percent as wide as the mandrel is long.

An example of the invention would be a 168 mm diameter mandrel (528 mm circumference) and a 578 mm circumferential length photoreceptor belt. The slot in the mandrel would be approximately 1.5 mm wide and 30 mm deep cut perpendicular to the center of the mandrel and lying across the full length of the mandrel. A key about 1 mm wide, 15 mm high and as long or slightly longer than the full length of a mandrel is used to secure the belt onto the mandrel. The ends of the key will be loaded by extension springs to keep the belt at a tension of about one pound per inch width of the belt. The belt wraps under tension around the entire circumference of the mandrel.

The belt itself can be of any type known in the art. A photoconductive layer for use in xerography may be a homogeneous layer of a single material such as vitreous selenium, or preferably, a composite layer containing a photoconductor and another material. Photoconductive layers used in electrophotographic belts are illustrated in U.S. Pat. No. 4,265,990, herein incorporated by reference. Typical photoconductive materials include amorphous selenium, trigonal selenium, and selenium alloys such as selenium-tellurium, selenium-tellurium-arsenic, selenium-arsenic, and mixtures thereof. The charged generation layer may comprise a homogeneous or a conductive material or particulate photoconductive material disposed on a binder. Any multilayered photoreceptor belt known to those of ordinary skill in the art may be applicable to the current apparatus.

Certain preferred options include a photosensor mechanism associated with the electrophotographic printing equipment to determine the location of the slot and corresponding gap in the photoreceptor belt on the mandrel to allow repositioning of the mandrels rotation to avoid casting a latent image onto a portion of the photoreceptor belt including the gap. A cap could also be placed in the photoreceptor belt gap. The cap would prevent toner from entering the slot. Cap materials may be metallic or plastic. Extrusion or casting means may be used to form the cap.

The apparatus of the current invention achieves significant advantages over the belt or drum mechanisms of the prior art. In a typical photoreceptor belt module, the belt passes through several rollers and experiences a large degree of bending which causes mechanical fatigue. The life span of this type belt apparatus can be fairly short. The current invention minimizes the mechanical strain on the photoreceptor belt allowing for longer life. Furthermore, the mandrel design does not have the intricate workings of a belt module and is accordingly less expensive to manufacture and repair. The drum photoreceptor design, often utilized in tandem color printing machines, is expensive to manufacture and replace. There is significant cost benefit to replacing solely the photoreceptor belt on the mandrel as opposed to an entire photoconductor drum. In addition, there is ease of replacement which provides a significant savings in down time and repair costs.

Thus it is apparent that there is provided, in accordance with the invention, a photoreceptor apparatus that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus described the invention, it is claimed:

1. A photoreceptor apparatus comprising:

a mandrel having a cylindrical axis and a slot running generally parallel to said cylindrical axis;

a continuous photoreceptor belt; and a releasable key positioned in said slot tensionally securing said photoreceptor belt to a periphery of said mandrel.

2. The apparatus of claim 1 wherein said photoreceptor belt is multilayered.

3. The apparatus of claim 1 wherein said mandrel has a length "l" and said key has a length equal to or greater than 1.

4. The apparatus of claim 1 wherein said photoreceptor belt is approximately 5–25 percent longer in length than the circumference length of said mandrel.

5. The apparatus of claim 1 wherein said slot is filled or covered.

6. A photoreceptor apparatus comprising a cylindrical mandrel having two parallel planar circular ends at the terminal ends of a body of length "l" having a longitudinal slot, said ends and said body having a circumference "c", a photoreceptor belt having a length "L" and a width "w" wherein L is greater than c and w is at least fifty percent of 1, a releasable key tensionally securing said photoreceptor belt in said slot and in tensioned contact with said body throughout circumference c.

7. The apparatus of claim 6, wherein w is at least ninety percent of 1.

8. An electrophotographic imaging process comprising:

charging a photoconductive member to a substantially uniform potential;

said photoconductive member comprising a photoreceptor belt attached to a cylindrical mandrel, said mandrel including a slot, said photoreceptor belt secured in said slot and in a tensioned relationship against said mandrel of between about one-half to two pounds per inch width of said photoreceptor belt with a releasable key;

exposing said charged photoconducting member to a light reflected image to dissipate portions of said charge;

transferring toner to said charge;

transferring said toner to a copy sheet.

9. A photoreceptor apparatus which comprises:

a) a mandrel having a periphery and a longitudinal slot; and b) a releasable key including at least two springs securing a photoreceptor belt in said slot and under tension in contact with a portion of said periphery.

10. A photoreceptor apparatus comprising:

a mandrel having a cylindrical axis and a slot running generally parallel to said cylindrical axis;

a photoreceptor belt; and a releasable key comprising at least two springs functional to maintain said photoreceptor belt in said slot and tensionally secured to a periphery of said mandrels.

11. The apparatus of claim 10 wherein said tension comprises between about one half pound per inch width of said photoreceptor belt and about two pounds per inch width of said photoreceptor belt.

* * * * *